US006735915B1

(12) United States Patent
Johnson, III

(10) Patent No.: US 6,735,915 B1
(45) Date of Patent: May 18, 2004

(54) MASONRY ANCHORING SYSTEM

(75) Inventor: Ralph O. Johnson, III, Charlotte, NC (US)

(73) Assignee: Masonry Reinforcing Corp. of America, Charlotte, NC (US)

( * ) Notice: Subject to any disclaimer, the term of this patent is extended or adjusted under 35 U.S.C. 154(b) by 0 days.

(21) Appl. No.: 10/289,031

(22) Filed: Nov. 6, 2002

(51) Int. Cl.[7] ..... E04B 1/16

(52) U.S. Cl. ..... 52/379; 52/513; 52/712; 52/426; 52/428; 52/562

(58) Field of Search ..... 52/379, 513, 712, 52/426, 428, 383, 562

(56) References Cited

U.S. PATENT DOCUMENTS

| | | | | | |
|---|---|---|---|---|---|
| 3,277,626 | A | * | 10/1966 | Brynjolfsson et. al. | 52/713 |
| 3,300,939 | A | * | 1/1967 | Brynjolfsson et al. | 52/713 |
| 3,309,828 | A | * | 3/1967 | Tribble | 52/426 |
| 3,377,764 | A | * | 4/1968 | Storch | 52/713 |
| 3,964,226 | A | * | 6/1976 | Hala et al. | 52/562 |
| 4,240,233 | A | * | 12/1980 | Vercelletto | 52/127.3 |
| 4,660,342 | A | * | 4/1987 | Salisbury | 52/358 |
| 4,819,401 | A | | 4/1989 | Whitney, Jr. | |
| 4,852,320 | A | * | 8/1989 | Ballantyne | 52/302.3 |
| 4,869,038 | A | | 9/1989 | Catani | |
| 4,946,632 | A | * | 8/1990 | Pollina | 264/33 |
| 5,408,798 | A | * | 4/1995 | Hohmann | 52/562 |
| 5,454,200 | A | | 10/1995 | Hohmann | |
| 5,845,455 | A | | 12/1998 | Johnson, III | |
| 5,915,745 | A | | 6/1999 | Looverie et al. | |
| 6,199,344 | B1 | | 3/2001 | Looverie et al. | |
| 6,279,283 | B1 | | 8/2001 | Hohmann et al. | |
| 6,460,824 | B1 | | 10/2002 | Lancelot, III et al. | |

* cited by examiner

*Primary Examiner*—Carl D. Friedman
*Assistant Examiner*—Nahid Amiri
(74) *Attorney, Agent, or Firm*—Adams Evans P.A.

(57) ABSTRACT

An masonry anchor is disclosed for anchoring two spaced apart masonry walls together to form a single wall structure. The masonry anchor includes a ladder or truss type support frame for positioning on top of a mortar joint in one wall, and a bracket having a pair of elongate arms connected by a cross-member affixed to the support frame. The cross-member is angled for providing two spaced apart points on the cross-member for contacting the support frame and affixing the cross-member thereto. The elongate arms extend transversely from the support frame and are sized to extend into the space between the two walls. Each of the arms have an eye portion formed at the end opposite the cross-member to receive a connecting member connected to the second wall. The support frame and the bracket reside in the same horizontal plane.

18 Claims, 6 Drawing Sheets

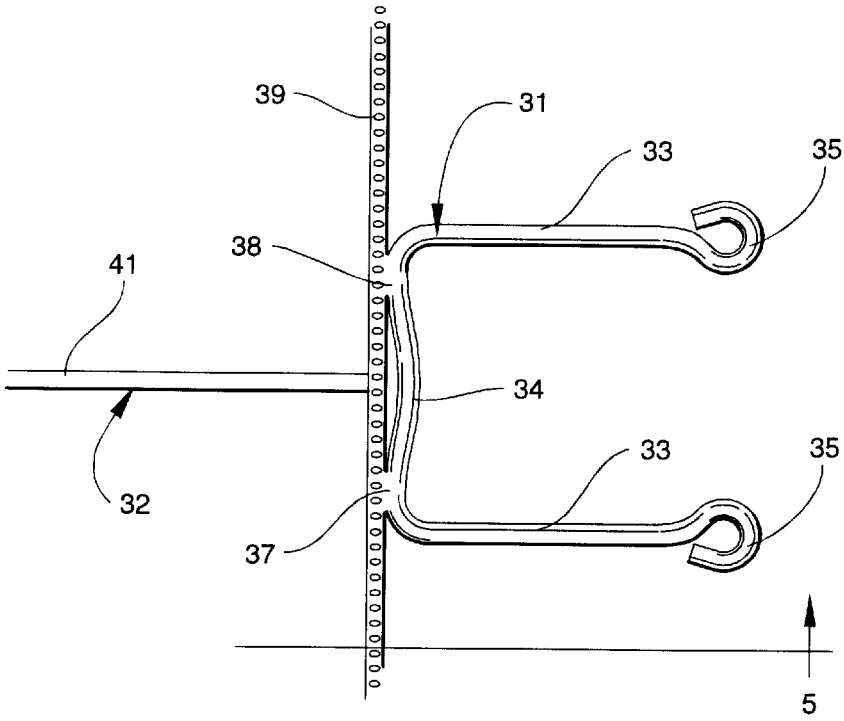
Fig. 6
Fig. 7
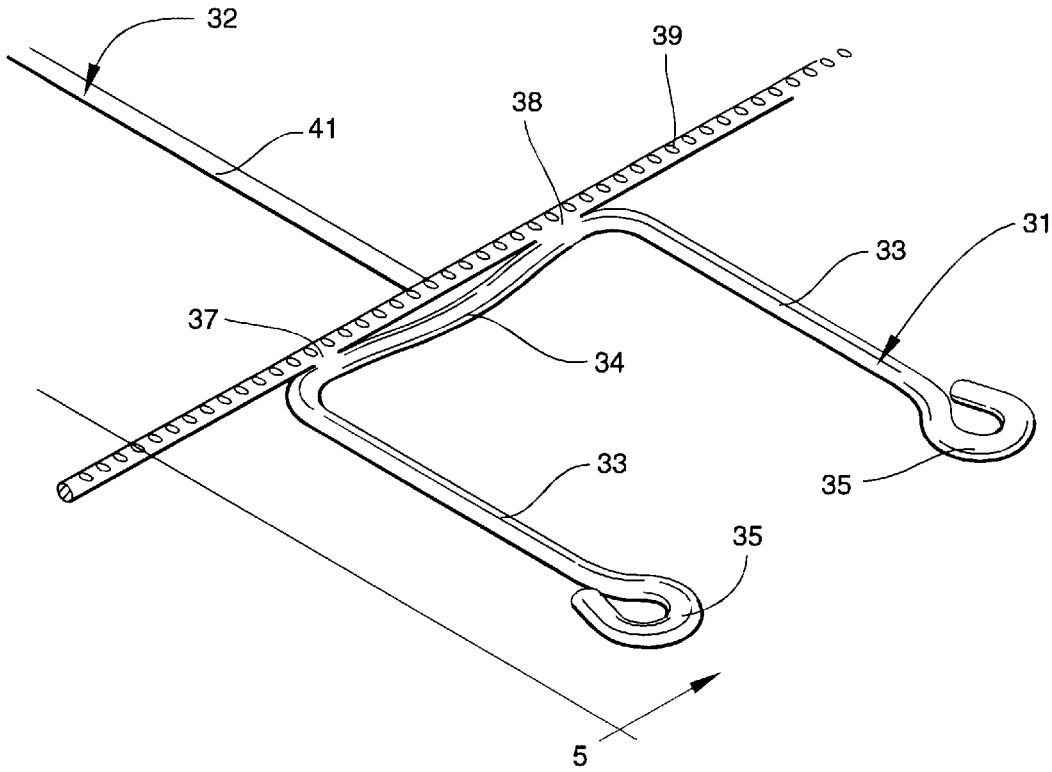

MASONRY ANCHORING SYSTEM

TECHNICAL FIELD AND BACKGROUND OF THE INVENTION

The invention relates to a masonry anchor for use in connecting two spaced apart masonry walls to form a single unified wall structure. The masonry anchor of the present invention can be easily and efficiently produced, and results in improved structural stability in the wall structure.

It is common in masonry construction for wall structures to comprise an inner wall, typically of concrete block construction to provide structural stability, and a spaced-apart outer veneer wall, often made of brick, principally for aesthetic purposes. Masonry anchors have long been used for anchoring the two walls together to help form a single unified wall structure. Prior art masonry anchors are generally made of metal wire and typically comprised a ladder or truss-type support frame that is positioned on a mortar joint of the inner wall coplanar with a mortar joint in the outer wall. A plurality of U-shaped brackets extend outwardly from the support frame and have eyes extending into the cavity between the two walls for receiving a connecting member, such as a wall tie, connected to the outer wall. Mortar is then filled over the masonry anchor. The process is repeated for successive mortar joints to unify the two walls into a single stable structure.

One prior art masonry anchor has a U-shaped bracket welded on top of the support frame at three different points. As such, the support frame and U-shaped bracket occupy two different horizontal planes, increasing the overall thickness of the structure and occupying most of the thickness of the mortar joint in which the masonry anchor is positioned. This diminishes the structural integrity of the wall structure, as the stability of the wall structure is largely dependent on the thickness and integrity of the mortar in the mortar joint.

Another prior art masonry anchor has pairs of parallel elongate arms extending outward from the support frame. Eyes are formed at the end of the arms for receiving a complimentary wall tie. The arms are aligned with the support frame, but the product is difficult to manufacture, as the arms are two separate pieces that must be individually welded to the support frame while being held in the same plane as the support frame.

In an effort to overcome and eliminate the aforementioned problems, the present invention was conceived.

SUMMARY OF THE INVENTION

Therefore it is an object of the present invention to provide an adjustable joint reinforcing system that can be efficiently and easily produced.

It is another object of the invention to provide a masonry anchor that yields improved structural stability when Connecting two spaced apart walls by maximizing the available space for mortar in the mortar joint surrounding the anchor.

These and other objectives of the present invention are achieved by providing a masonry anchor for connecting two spaced-apart walls defining a cavity therebetween. The masonry anchor includes an elongate support frame for being embedded in a mortar joint of the first wall, and a plurality of brackets carried by the support frame in spaced-apart relation along a length thereof in a common plane defined by the support frame and adapted for extending outwardly from the support frame into the cavity for connection to a like plurality of spaced-apart connecting members embedded in a mortar joint of the second wall. Each bracket includes two laterally spaced-apart arms, each arm having an eye on an outwardly extending end portion thereof for receiving a respective hook carried by the connecting member. A cross-member extends between the two arms. The cross-member is shaped so as to have a concavity in relation to the support frame and two spaced-apart welding contact points where the bracket is welded to the support frame.

According to one preferred embodiment of the invention, each of the brackets comprise a single metal wire.

According to another preferred embodiment of the invention, the cross-member is formed at an angle of approximately 170 degrees in relation to the support frame.

According to yet another preferred embodiment of the invention, the spaced-apart welding contact points are proximate opposite ends of said cross-member.

According to yet another preferred embodiment of the invention, the elongate support frame comprises two elongate wires connected by a plurality of transverse wires at spaced apart intervals along the two elongate wires.

According to yet another preferred embodiment of the invention, the brackets are affixed to one of the elongate wires of the support frame.

According to yet another preferred embodiment of the invention, each of the brackets is affixed to the elongate wire at spaced apart intervals corresponding with the plurality of transverse wires.

According to yet another preferred embodiment of the invention, the elongate wires extend parallel to each other and perpendicular to the plurality of transverse wires.

According to yet another preferred embodiment of the invention, the elongate wires extend parallel to each other, the plurality of transverse wires extend diagonally between the the elongate wires, and each of the transverse wires are connected to the first and second elongate wires proximate a successive transverse wire to form a wire truss.

According to yet another preferred embodiment of the invention, the connecting members are wall ties.

A preferred embodiment of the method for anchoring two spaced apart walls together to form a single wall structure according to the invention comprises the steps of providing a masonry anchor having an elongate support frame for being embedded in a mortar joint of the first wall, and a plurality of brackets carried by the support frame in spaced-apart relation along a length thereof in a common plane defined by the support frame and adapted for extending outwardly from the support frame into the cavity for connection to a like plurality of spaced-apart connecting members embedded in a mortar joint of the second wall and extending outwardly into the cavity therefrom. Each bracket includes first and second laterally spaced-apart arms, each arm having an eye on an outwardly extending end portion thereof for receiving a respective hook carried by the connecting member, and a cross-member extending between the first and second arms. The cross-member is shaped to define a concavity in relation to the support frame and two spaced-apart welding contact points where the bracket is welded to the support frame. The support frame is positioned on the mortar joint of the first wall, and the hooks of the connecting members are positioned into the eyes of the brackets. The connecting member is positioned on a mortar joint of the second wall. The support frame is affixed to the first wall and the connecting member is affixed to the second wall to form a single wall structure.

In another preferred embodiment of the method for anchoring first and second spaced apart walls together according to the invention, the step of affixing the support frame to the first wall and affixing the connecting member to the second wall includes depositing mortar on the mortar joints of the first and second walls.

BRIEF DESCRIPTION OF THE DRAWINGS

Some of the objects of the invention have been set forth above. Other objects and advantages of the invention will appear as the invention proceeds when taken in conjunction with the following drawings, in which:

FIG. 6 is a partial top plan view of the masonry anchor of FIG. 4;

FIG. 7 is a partial perspective view of the masonry anchor of FIG. 4;

DESCRIPTION OF THE PREFERRED EMBODIMENT AND BEST MODE

Prior Art

Figures 1, 2:
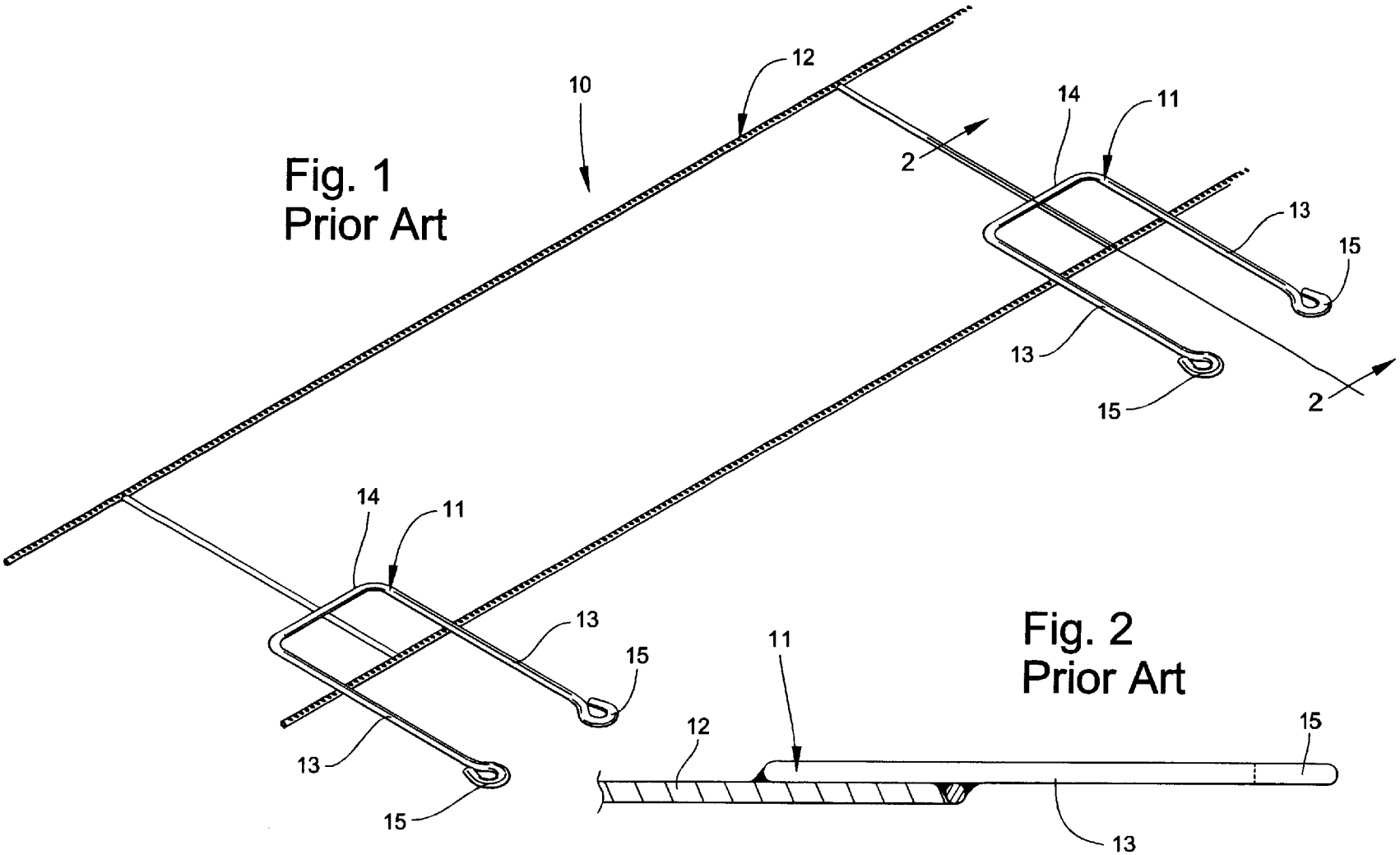
Fig. 1 Prior Art
Fig. 2 Prior Art
FIG. 1 is a perspective view of a prior art masonry anchor.
FIG. 2 is a partial cross sectional view of the masonry anchor of FIG. 1, shown along lines 2—2.

Referring now specifically to the drawings, a prior art masonry anchor is illustrated in FIG. 1, and shown generally at reference numeral 10. The prior art masonry anchor comprises U-shaped wire bracket 11 affixed on a ladder-type support frame 12. The U-shaped bracket 11 has a pair of parallel elongate arms 13 connected by a cross wire 14 extending transversely from the support frame 12. Eyes 15 are formed at the ends of the elongate arms 13, and shaped to receive a complimentary connecting member, such as a wall tie.

As shown in FIG. 2, the U-shaped bracket 11 is welded to one surface of the support frame 12, and occupies a different horizontal plane than the support frame 12. This increases the overall thickness of the anchor 10, resulting in less space available for filling mortar. The support frame 12 is typically comprised of a metal wire having a thickness of 0.148 inch, and the bracket 11 generally has a thickness of 0.187 inch, yielding a total thickness for anchor 10 of 0.335 inch. The typical concrete block mortar joint has a thickness of 0.375 inch. Thus, the anchor 10 occupies at least 89% of the thickness within the mortar joint. The relatively limited area available for mortar within the mortar joint has a detrimental effect on the structural stability of the wail structure. In addition, the U-shaped bracket 11 of masonry anchor 10 is welded at three points on the support frame 12, increasing time and costs associated with producing the anchor 10, in comparison with the present invention.

Figure 3:
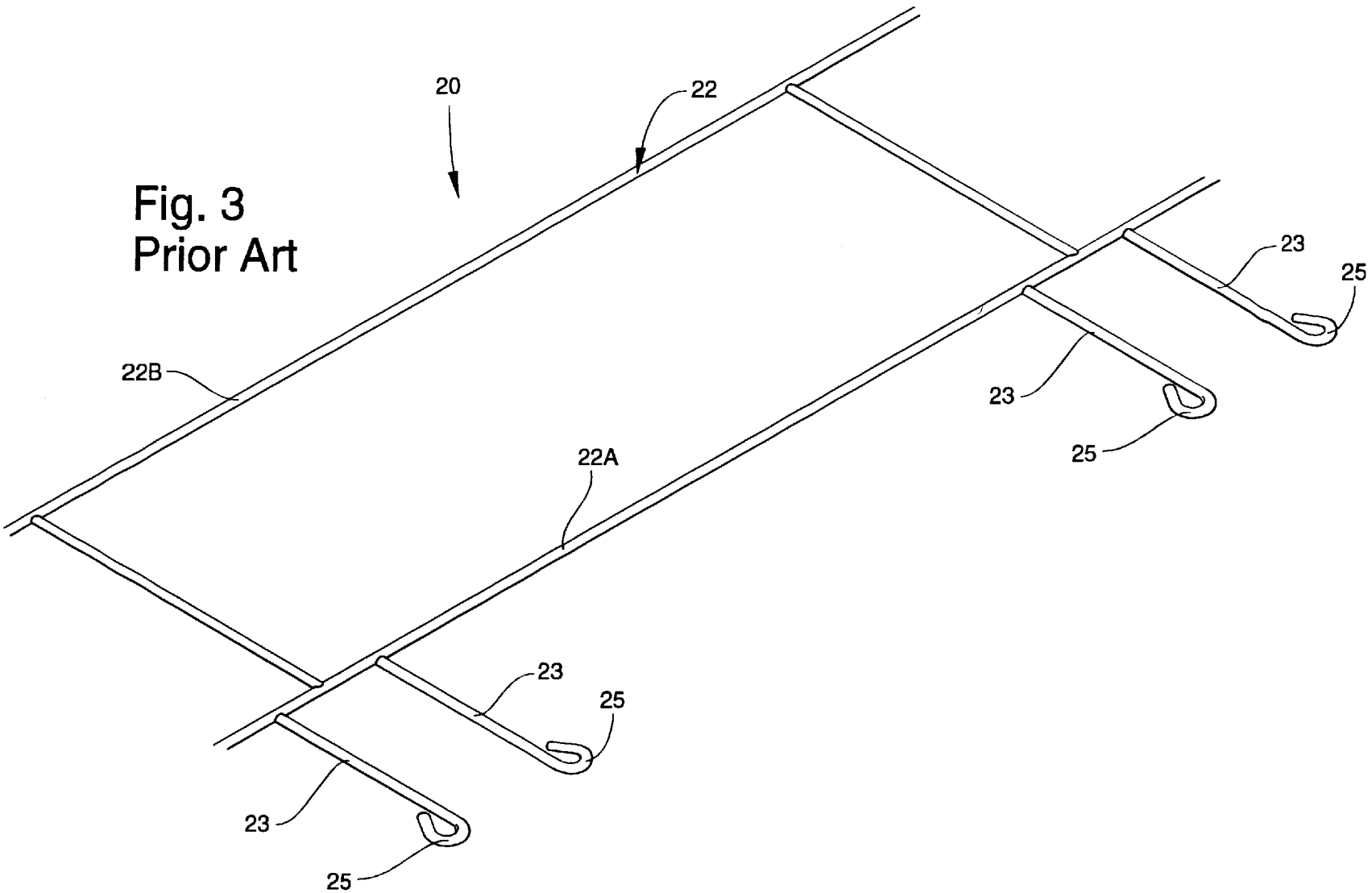
Fig. 3 Prior Art
FIG. 3 is a perspective view of another prior art masonry anchor.

FIG. 3 shows another prior art masonry anchor 20, which comprises a support frame 22, with pairs of parallel elongate arms 23 extending outward. Eyes 25 are formed at the end of arms 23 for receiving a complimentary wall tie. The arms 23 are individually welded to the support frame 22 on either side of the transverse wire 26 connecting the parallel wires 22A, 22B of the support frame 22.

Preferred Embodiments of the Invention

Figures 4, 5:
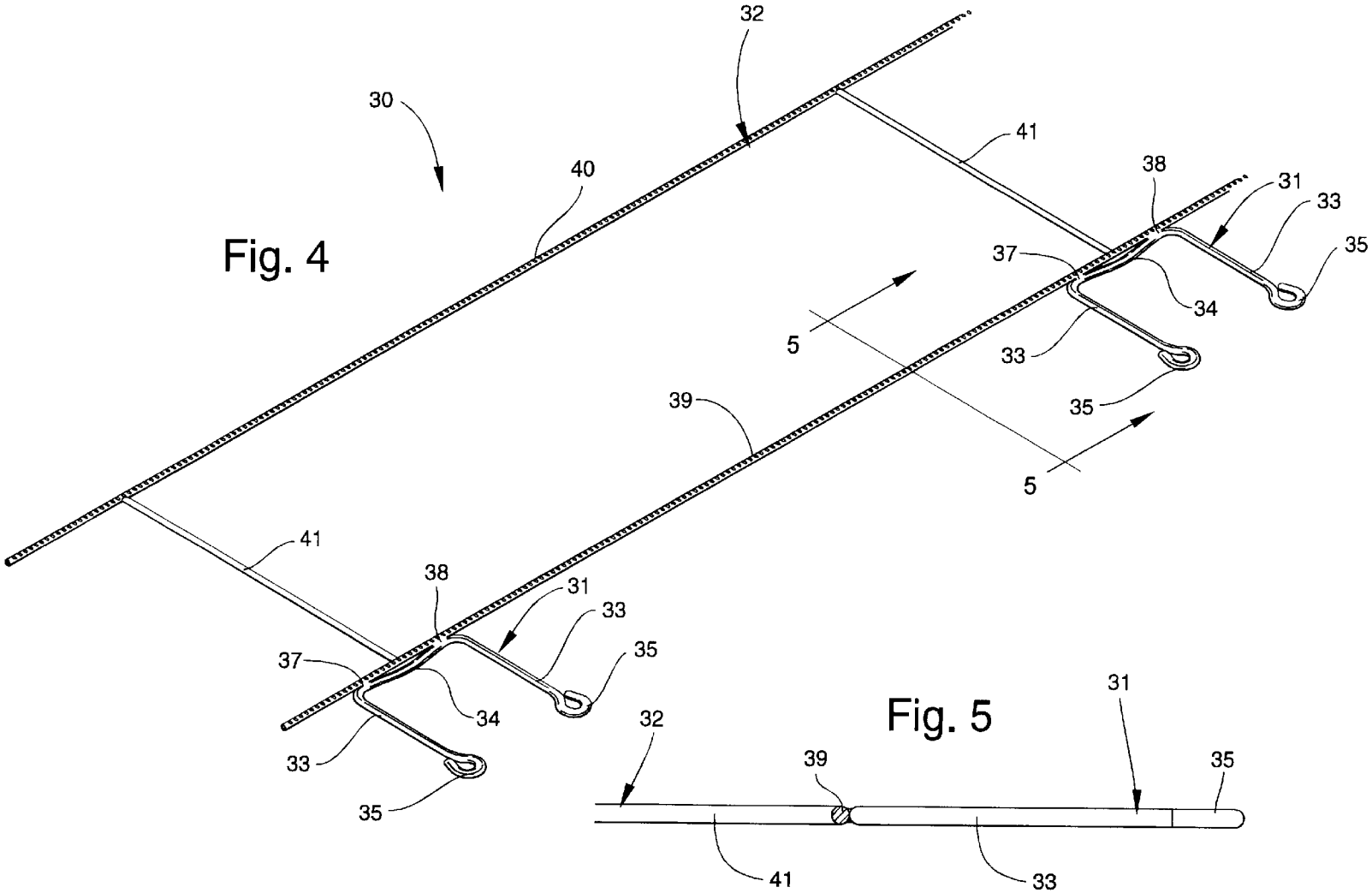
FIG. 4 is a perspective view of a preferred embodiment of the masonry anchor according to the present invention.
FIG. 5 is a partial cross sectional view of the masonry anchor of FIG. 4, shown along lines 5—5.
Figure 9:
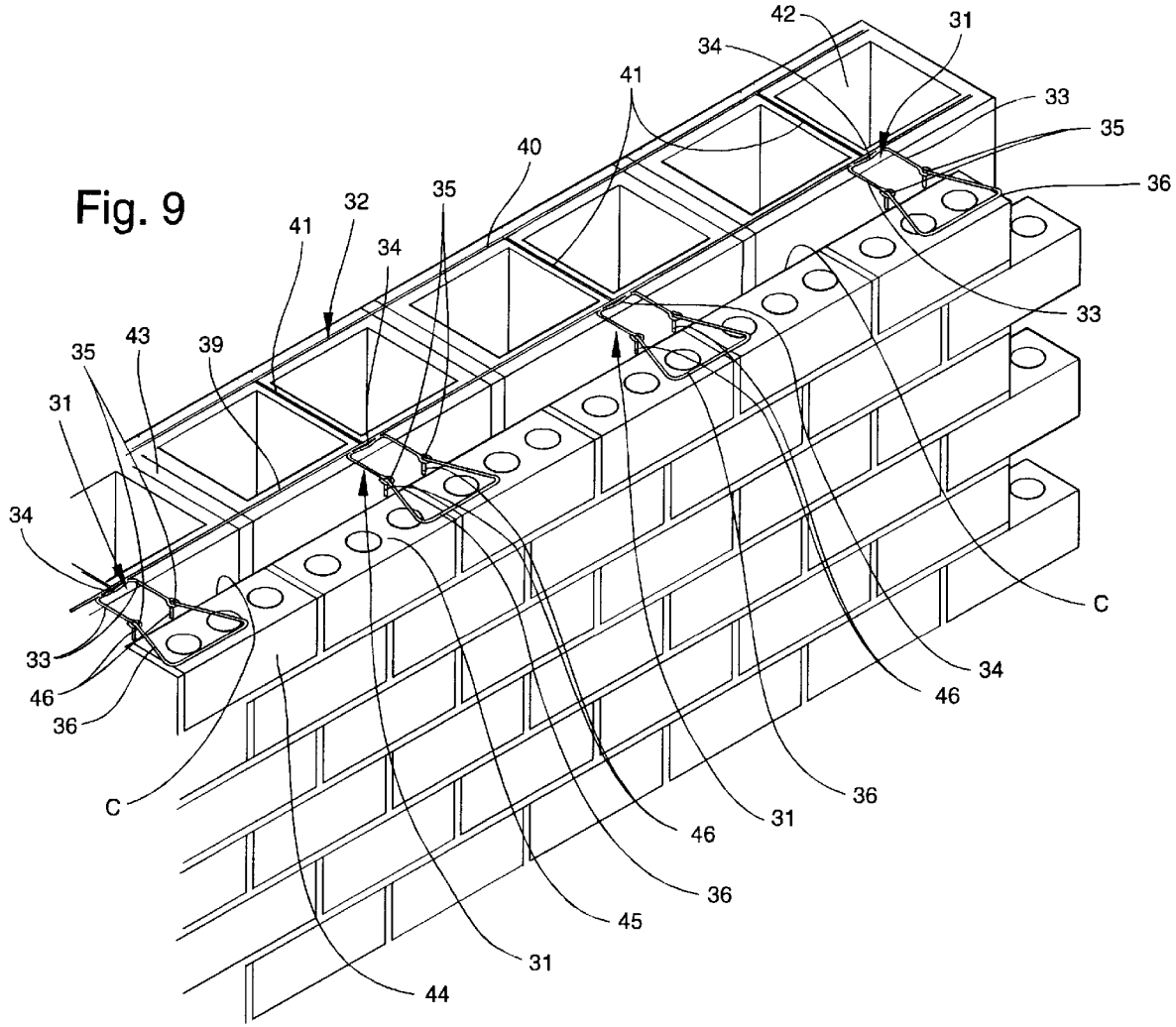
FIG. 9 is an environmental view of the masonry anchor of FIG. 4.

A preferred embodiment of the masonry anchor according to the present invention is illustrated in FIG. 4, and shown generally at reference numeral 30. The masonry anchor 30 comprises a U-shaped bracket 31 affixed to a support frame 32 formed of two parallel metal wires 39, 40 joined by a plurality of transverse metal wires 41. The transverse wires 41 are connected to the wires 39, 40 at equally spaced apart intervals to form a ladder-type frame. The transverse wires 41 are spaced apart such that the support frame 32 correspondingly aligns with the top transverse surface of a typical concrete block wall 42, as shown in FIG. 9. The U-shaped bracket 31 includes a pair of parallel elongate arms 33 connected by a cross wire 34 extending transversely from the support frame 32. Eyes 35 are formed at the ends of the elongate arms 33, and shaped to receive a respective hook 46 from a complimentary connecting member such as a wall tie 36, as shown in FIG. 9. As shown in FIGS. 6 and 7, the eyes 35 preferably have a true circle or lollipop shape that reduces the area in which the hook 46 of the wall tie 36 can move. The restricted movement of the hooks 46 within the eyes 35 improves stability of the finished wall structure.

The cross wire 34 of the bracket 31 is bent inwardly at the center to produce two spaced apart welding points 37, 38 extending out slightly further than the rest of the cross wire 34. The area between the welding points 37, 38 forms a concavity with relation to the support frame 32. As such, the two points 37, 38 are the only areas of the cross wire 34 that contact the support frame 32, thus providing two discrete welding points 37, 38 for easily and efficiently welding the bracket 34 to the support frame 32 in precise alignment with the thickness of the support frame 32 during a single welding operation. Welding the bracket 31 to the support frame at only two points 37, 38 expends less energy than welding all of a linear cross wire to the support frame. In addition, attempting to weld a linear cross wire to the support frame results in a weaker connection between the bracket and support frame.

As shown in FIGS. 6 and 7, the cross wire 34 is welded to the wire 39 at the two spaced apart points 37, 38, that are on opposite sides of the point where the transverse wire 41 intersects and is welded to wire 39, as shown in FIG. 4. As shown in FIG. 5, the U-shaped bracket 31 resides in the same horizontal plane as the support frame 32, thereby maximizing available space for mortar filling. Because the masonry anchor 10 occupies a single horizontal plane, a heavy duty gauge metal wire, having, for example, a thickness of 0.187 inches can be used for all parts of the anchor 40. As such, masonry anchor 40 can be comprised completely of the 0.187 inch gauge metal wire and still occupy less than fifty percent of the typical 0.375 inch thickness of a mortar joint, while prior art bi-planar anchors, such as anchor 10, typically require the use of a lesser gauge wire, such as 0.148 inch, for the support frame in order to provide just minimal space for the mortar. In addition, prior art anchor 10, due to the length of arms 13, requires more metal wire material to produce its U-shaped bracket 12, than does bracket 31 in anchor 30.

As shown in FIG. 9, the support frame 32 is positioned on top of a course of the concrete block wall 42. The elongate arms 33 of the U-shaped bracket 31 extend outward from the support frame 32 and into a cavity "C" between the concrete block wall 42 and a brick masonry wall 44. The concrete block wall 42 and the brick wall 44 are designed to have corresponding mortar joints 43, 45, respectively, generally residing in the same horizontal plane. Wall ties 36 have hooks 46 that are received within the eyes 35 of the U-shaped bracket 31. The wall ties 36 are positioned in the mortar joint 45 of the brick wall 44. Mortar is then filled over the mortar joints 43, 45. The process is repeated at required vertical intervals in the walls 42, 44 to form a securely unified single wall structure.

The U-shaped bracket 31 of masonry anchor 30 is preferably made of a metal wire having a thickness of 0.187 inch. The support frame 32 is preferably made of a metal wire having a thickness of 0.148 inch. Preferably, the cross wire 34 is angled approximately 170 degrees.

Figure 8:
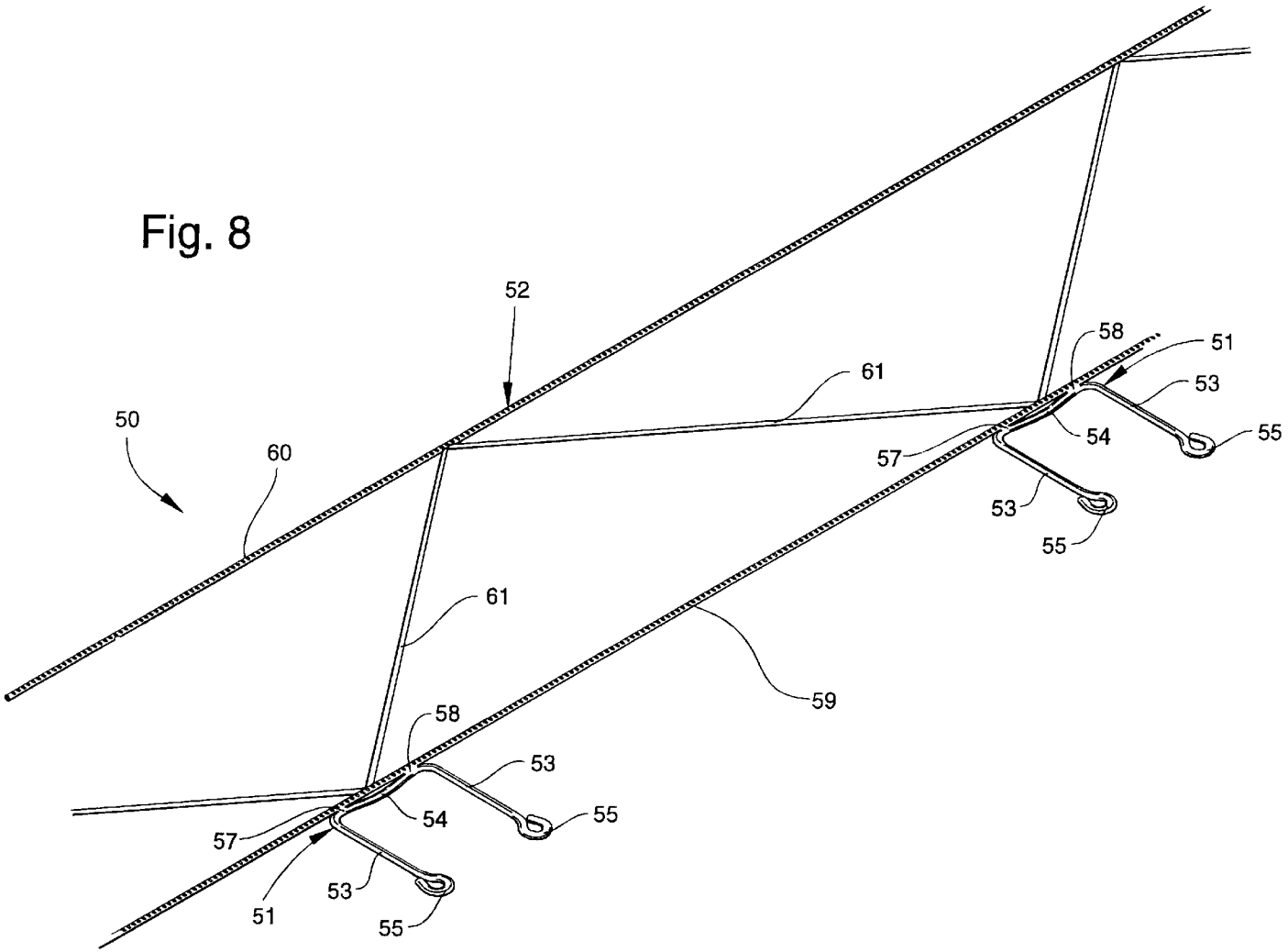
FIG. 8 is a perspective view of another preferred embodiment of the masonry anchor according to the invention.

Another preferred embodiment of the invention is illustrated in FIG. 8, and shown generally at reference numeral 50. The masonry anchor 50 is identical to the above described masonry anchor 30 in all respects, except that masonry anchor 50 includes a truss-type support frame 52, rather than the ladder-type frame 32 described above.

The support frame 52 includes a pair of elongate parallel metal wires 59, 60 joined by a plurality of transverse metal wires 61 extending diagonally between the elongate wires 59, 60 at equally spaced apart intervals to form the truss-type frame 52. Masonry anchor 50 also includes a U-shaped bracket 51 having a pair of parallel arms 53 connected by a cross wire 54, and extending transversely from the support frame 52. Eyes 55 are formed at the ends of the elongate arms 53, and shaped to receive a complimentary connecting member. The cross wire 54 of U-shaped bracket 51 is angled at the center to produce two spaced apart welding points 57, 58 extending out slightly further than the rest of the cross wire 54. The cross wire 54 is welded to the elongate wire 59 at the welding points 57, 58. The U-shaped bracket 51 is welded to the elongate wire 59 at each point along the wire 59 in which two transverse wires 61 connect to the elongate wire 59.

The bracket 51 can be efficiently made in a welding process in which a plurality of the brackets 51 are loaded, one on top of the other, into a magazine. The support frame 52 is positioned on a conveyor proximate the magazine. Brackets 51 are fed one by one through an exit at the bottom of the magazine by a pneumatic cylinder. A clamp ensures that the ejected bracket 51 is aligned in the same horizontal plane with the support frame 52, and the ejected bracket 51 is welded to support frame 52 at welding points 57, 58. The support frame 52 is indexed down the conveyor, and another bracket 51 is ejected from the magazine and welded to the support frame 52. The support frame 52 is indexed along the conveyor such that a bracket 51 is welded to the support frame 52 at approximately sixteen inch intervals.

A masonry anchor and method of using same is disclosed above. Various embodiments of the invention can be made without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A masonry anchor for connecting first and second spaced-apart walls defining a cavity therebetween, and comprising:

(a) an elongate support frame for being embedded in a mortar joint of said first wall;

(b) a plurality of brackets carried by said support frame in spaced-apart relation along a length thereof in a common plane defined by the support frame and adapted for extending outwardly from the support frame into the cavity for connection to a like plurality of spaced-apart connecting members embedded in a mortar joint of the second wall and extending outwardly into the cavity therefrom, each of said plurality of brackets comprising:

(i) first and second laterally spaced-apart arms, each arm having a connector on an outwardly extending end portion thereof for engaging a respective complimentary connector carried by each of the connecting members; and (ii) a cross-member extending between the first and second arms, said cross-member curved to have concave shape in relation to the support frame and first and second spaced-apart welding contact points where the bracket is welded to the support frame.

2. A masonry anchor according to claim 1, wherein each of said plurality of brackets comprises a single metal wire.

3. A masonry anchor according to claim 1, wherein said cross-member is angled approximately 170 degrees in relation to said support frame.

4. A masonry anchor according to claim 1, wherein said first and second spaced-apart welding contact points are proximate opposite ends of said cross-member.

5. A masonry anchor according to claim 1, wherein said elongate support frame comprises first and second elongate wires connected by a plurality of transverse wires at spaced apart intervals along said first and second elongate wires.

6. A masonry anchor according to claim 5, wherein said plurality of brackets is affixed to said first elongate wire of said support frame.

7. A masonry anchor according to claim 6, wherein each of said plurality of brackets is affixed to said first elongate wire at spaced apart intervals in corresponding alignment with said plurality of transverse wires.

8. A masonry anchor according to claim 5, wherein said first and second elongate wires extend parallel to each other and perpendicular to said plurality of transverse wires.

9. A masonry anchor according to claim 5, wherein said first and second elongate wires extend parallel to each other, said plurality of transverse wires extend diagonally between said first and second elongate wires, and each of said transverse wires are connected to said first and second elongate wires proximate a successive transverse wire to form a wire truss.

10. A masonry anchor according to claim 1, wherein the connector on the outwardly extending end portion of each said arm comprises an eye for receiving said respective complimentary connector carried by each of the connecting members.

11. A masonry anchor according to claim 10, wherein said respective complimentary connector carried by each of the connecting members comprises a hook.

12. A masonry anchor according to claim 1, wherein said connecting members comprise wall ties.

13. A masonry anchor comprising:

a bracket, said bracket comprising (a) comprising first and second laterally spaced-apart arms, each arm having a connector on an outwardly extending end portion thereof for engaging a respective complimentary connector carried by a connecting member embedded in a mortar joint of a first wall and extending outwardly into the cavity therefrom; and (b) an integral cross-member extending between the first and second arms, said cross-member curved to have concave shape define first and second spaced-apart welding contact points for welding the bracket to a support frame of the masonry anchor embedded in a mortar joint of a second wall, and a spaced-apart portion intermediate the first and second welding contact points.

14. A masonry anchor according to claim 13, wherein said bracket comprises a single metal wire.

15. A masonry anchor according to claim 13, wherein said first and second spaced-apart welding contact points are proximate opposite ends of said cross-member.

16. A masonry anchor according to claim 13, wherein the connector on the outwardly extending end portion of each said arm comprises an eye for receiving said respective complimentary connector carried by the connecting member.

17. A masonry anchor according to claim 13, wherein said respective complimentary connector carried by the connecting members comprises a hook.

18. A masonry anchor according to claim 13, wherein the connecting member comprises a wall tie.

* * * * *